United States Patent [19]

Fowler

[11] Patent Number: 4,689,879

[45] **Date of Patent: * Sep. 1, 1987**

[54] METHOD OF MAKING A MEMBRANE KEYBOARD

[75] Inventor: Daniel L. Fowler, Kentwood, Mich.

[73] Assignee: Robertshaw Controls Company, Richmond, Va.

[ * ] Notice: The portion of the term of this patent subsequent to Jun. 24, 2003 has been disclaimed.

[21] Appl. No.: 838,358

[22] Filed: Mar. 11, 1986

Related U.S. Application Data

[62] Division of Ser. No. 690,982, Jan. 14, 1985, Pat. No. 4,596,905.

[51] Int. Cl.[4] ..... H01H 11/04

[52] U.S. Cl. ..... 29/622; 156/87; 29/412; 29/830

[58] Field of Search ..... 29/622, 830, 412, 415; 156/87; 200/5 A, 159 B, 306

[56] References Cited

U.S. PATENT DOCUMENTS

| | | | |
|---|---|---|---|
| Re. 31,332 | 8/1983 | Larson | 200/5 A |
| 3,399,448 | 9/1968 | Jackson | 29/415 |
| 3,967,370 | 7/1976 | Griffin et al. | 29/622 |
| 3,995,126 | 11/1976 | Larson | 200/5 A |
| 4,018,999 | 4/1977 | Robinson et al. | 200/5 A |
| 4,046,975 | 9/1977 | Seeger, Jr. | 200/5 A |
| 4,237,358 | 12/1980 | Larson et al. | 200/5 A |
| 4,349,712 | 9/1982 | Michalski | 200/5 A |
| 4,365,130 | 12/1982 | Christensen | 200/5 A |
| 4,415,780 | 11/1983 | Daugherty et al. | 200/5 A |
| 4,499,343 | 2/1985 | Rioux et al. | 200/5 A |
| 4,508,942 | 4/1985 | Inaba | 200/5 A |
| 4,562,315 | 12/1985 | Aufderheide | 200/5 A |

*Primary Examiner*—Percy W. Echols

*Attorney, Agent, or Firm*—Candor, Candor & Tassone

[57] ABSTRACT

A membrane keyboard construction and method of making the same are provided, the membrane keyboard construction comprising two circuit layers, a spacer disposed and secured between the circuit layers and having an opening passing therethrough to permit the circuit layers to be pressed together in the opening and thereby provide a switching function, a face plate, and an adhesive layer disposed between the face plate and one of the circuit layers and securing the face plate to the one circuit layer, the adhesive layer having a passage therein and leading from an area thereof that is aligned in superimposed relation with the opening to the exterior of the construction to vent that area thereof. The area is isolated from the opening by the one circuit layer and is vented by the passage to tend to enhance tactile feel and avoid false switch closure of the opening by tending to prevent entrapment of air bubbles in the area.

20 Claims, 9 Drawing Figures

METHOD OF MAKING A MEMBRANE KEYBOARD

CROSS REFERENCE TO RELATED APPLICATION

This application is a divisional patent application of its copending parent patent application, Ser. No. 690,982, filed Jan. 14, 1985, now U.S. Pat. No. 4,596,905.

BACKGROUND OF THE INVENTION

1. Field of the Invention

This invention relates to a new membrane keyboard construction, such as the touch panel for an appliance, and to a new method of making such a membrane keyboard construction.

2. Prior Art Statement

It is known to provide a membrane keyboard construction comprising two circuit layer means, spacer means disposed and secured between the circuit layer means and having opening means passing therethrough to permit the circuit layer means to be pressed together in the opening means and thereby provide a switching function, a face plate means, and an adhesive layer means disposed between the face plate means and one of the circuit layer means and securing the face plate means to that one circuit means.

SUMMARY OF THE INVENTION

It is a feature of this invention to provide a new membrane keyboard construction wherein the adverse effects of trapped air in the construction is reduced.

In particular, it has been found according to the teachings of this invention that during the making of the aforementioned prior known membrane keyboard construction, air becomes trapped between the adhesive layer means and the circuit layer means and tends to migrate to and expand in the areas adjacent the opening means in the spacer means thereof whereby the expanded and entrapped air forces the circuit layers toward each other in the opening means of the spacer means disposed between the circuit layers. This may result in a false switch closure and/or reduces the switch travel required for a switch closure. This reduced switch travel from the normal switch travel, in turn, requires lighter actuation forces to close the switch circuits.

However, it was found according to the teachings of this invention that such entrapped air can be vented from adjacent the opening means in the spacer means during the making of a membrane keyboard construction so as to tend to reduce the aforementioned adverse effects of such entrapped air, such venting being provided by unique passage means formed in the adhesive layer means according to the teachings of this invention and as hereinafter illustrated and described.

For example, one embodiment of this invention provides a membrane keyboard construction comprising two circuit layer means, spacer means disposed and secured between the circuit layer means and having opening means passing therethrough to permit the circuit layer means to be pressed together in the opening means and thereby provide a switching function, a face plate means, and an adhesive layer means disposed between the face plate means and one of the circuit layer means and securing the face plate means to the one circuit layer means, the adhesive layer means having passage means therein and leading from an area thereof that is aligned in superimposed relation with the opening means to the exterior of the construction to vent that area thereof. The area is isolated from the opening means by the one circuit layer means and is vented by the passage means to tend to enhance tactile feel and avoid false switch closure of the opening means by tending to prevent entrapment of air bubbles in the area.

Accordingly, it is one object of this invention to provide a new membrane keyboard construction having one or more of the novel features of this invention that is set forth above or hereinafter shown or described.

Another object of this invention is to provide a new method of making a membrane keyboard construction, the method of this invention having one or more of the novel features of this invention that is set forth above or hereinafter shown or described.

Other objects, uses and advantages of this invention are apparent from a reading of this description which proceeds with reference to the accompanying drawings wherein:

DESCRIPTION OF THE PREFERRED EMBODIMENTS

Figure 4:
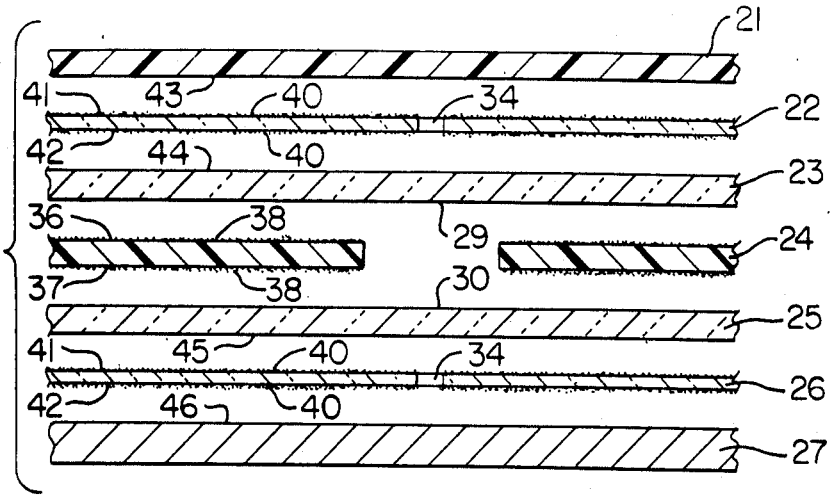
FIG. 4 is an exploded view of the various layers of the membrane keyboard construction of FIG. 1.

While the various features of this invention are hereinafter shown or described as being particularly adapted to be utilized for a touch control panel for a domestic appliance, it is to be understood that the various features of this invention can be utilized singly or in any combination thereof to provide a membrane keyboard construction or other apparatus as desired.

Therefore, this invention is not to be limited to only the embodiments illustrated in the drawings, because the drawings are merely utilized to illustrate one of the wide variety of uses of this invention.

Figure 1:
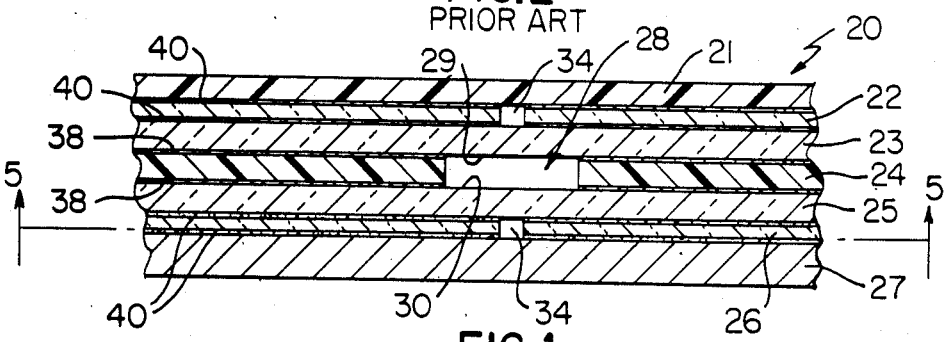
FIG. 1 is a fragmentary cross-sectional view illustrating the new membrane keyboard construction of this invention.
Figure 5:
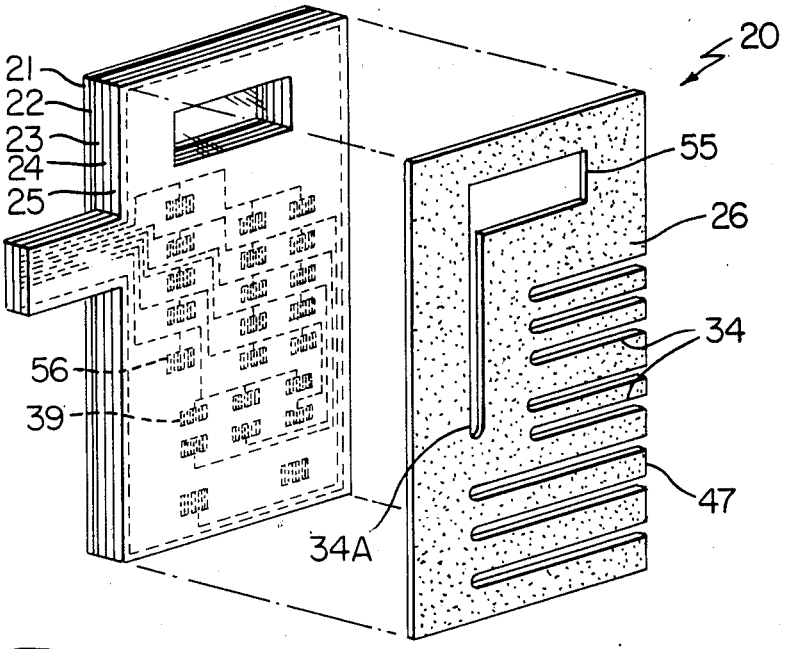
FIG. 5 is an exploded reduced perspective view of the membrane keyboard construction of FIG. 1 and is taken on the line 5—5 of FIG. 1.
Figure 6:
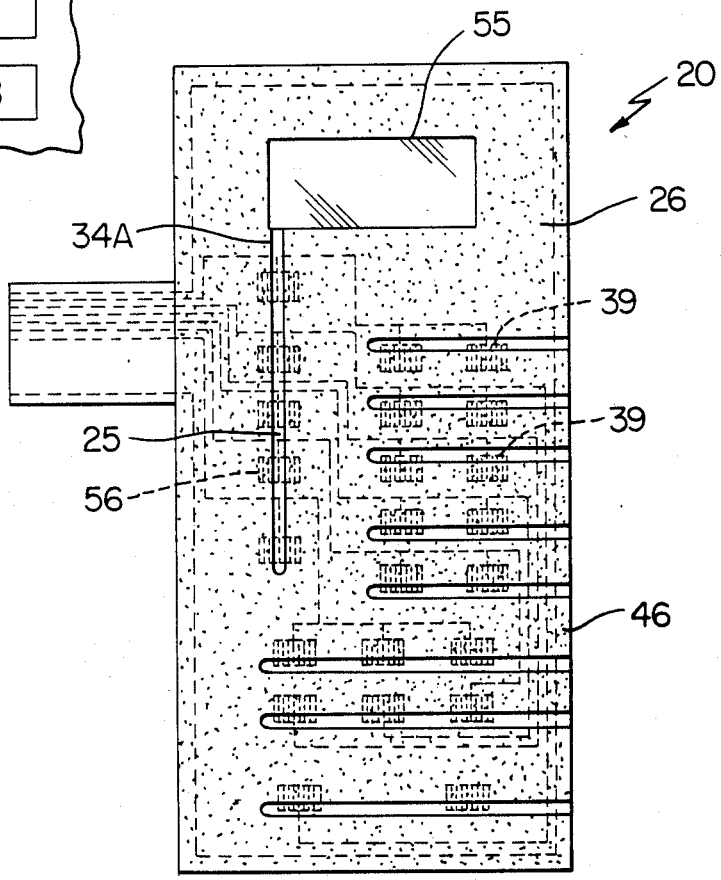
FIG. 6 is an enlarged plan view of the structure of FIG. 5.

Referring now to FIG. 1, the new membrane keyboard construction of this invention is generally indicated by the reference numeral 20 and comprises a face plate means 21, a first adhesive layer means 22, a first circuit layer means 23, a spacer means 24, a second circuit layer means 25, a second adhesive layer means 26 and a backing plate means 27, the means 21–27 being secured together in a manner hereinafter set forth and being illustrated as being relatively thick whereas such layers 21–26 are relatively thin sheet-like layers and the backing plate means 27 normally comprises a metallic frame plate means of an appliance or the like. Thus, the membrane keyboard construction 20 normally is initially formed of just the layer 21–26 as illustrated in FIGS. 5 and 6 and then is assembled to the desired appliance by being secured to the backing plate means 27 at a later time as desired.

Therefore, it can be seen that the membrane keyboard construction 20 of this invention can comprise just the layers 21–26 or include the layer 27 therewith as will be apparent hereinafter.

In any event, it can be seen that the membrane keyboard construction 20 of this invention is conventional in the art except for a unique air venting feature thereof that is hereinafter described and that tends to reduce the adverse effects of air that becomes entrapped in the adhesive layers of prior known membrane keyboard constructions during the making thereof.

Figure 2:
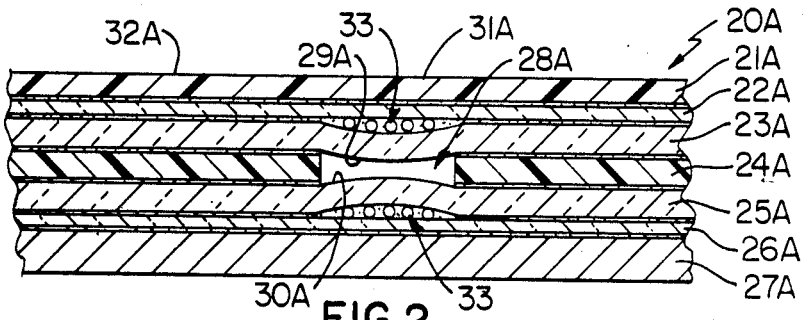
FIG. 2 PRIOR ART
FIG. 2 is a view similar to FIG. 1 and illustrates a prior known membrane keyboard construction.

For example, reference is now made to FIG. 2 wherein a prior known membrane keyboard construction is generally indicated by reference numeral 20A and parts thereof similar to the parts of the membrane keyboard construction 20 of this invention are indicated by like reference numerals followed by the reference letter "A".

Figure 3:
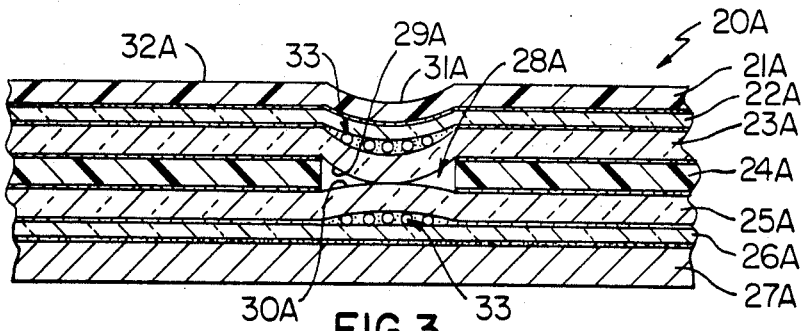
FIG. 3 PRIOR ART
FIG. 3 is a view similar to FIG. 2 and illustrates the prior known membrane keyboard construction in another operating condition thereof.

As illustrated in FIG. 2, the spacer means 24A has an opening means 28A passing therethrough to permit the surface 29A of the circuit layer means 23A to be pressed against the surface 30A of the circuit layer means 25A to close or complete an electrical circuit therebetween in a manner well known in the art and as illustrated in FIG. 3 by an operator pressing a finger or the like against an area 31A on the outer surface 32A of the face plate means 21A that is aligned with the particular opening means 28A in the spacer means 24A. Such closed circuit is opened by the operator merely releasing pressure on the area 31A of the face plate means 21A as the circuit layer means 23A and face plate means 21A have a normal bias to move away from the circuit layer means 25A at the opening means 28A as illustrated in FIG. 2.

However, it has been found according to the teachings of this invention that during the making of the membrane keyboard construction 20A by laminating the layers 21A–26A together with a roll pressing operation in a manner conventional in the art, as well as then laminating the layers 21A–26A to the backing plate means 27A, air that is generally indicated by the reference numeral 33 in FIGS. 2 and 3 tends to be trapped between the face plate means 21A and the first circuit layer means 23A as well as between the second circuit layer means 25A and the backing plate means 27A and tends to migrate to the areas therebetween that are aligned with the opening means 28A where the air 33 can expand and have a detrimental effect on the operation of the membrane keyboard construction 20A.

In particular, the entrapped and expanded air 33 in the membrane keyboard construction 20A will force the circuit layers 23A and 25A toward each other at the opening means 28A and may result in a false switch closure and/or reduce the switch travel distance for a switch closure. This reduced normal switch travel distance, in turn, requires a lighter actuation force by the operator to close a switch of the membrane keyboard construction 20A which is undesirable because normal "feel" for switch closure will not be provided.

Also, because each membrane keyboard construction 20A has a plurality of spaced apart openings 28A in a particular keyboard pattern in a manner well known in the art, certain of the switch means thereof may have a more adverse air entrapment problem than other switch means thereof for the above reasons.

However, it has been found according to the teachings of this invention that the adverse effect of air entrapment can be reduced if suitable means are provided in the membrane keyboard construction to vent the entrapped air to the exterior of the construction so that a suitable distance will normally be provided between the adjacent circuit layer means at each opening means of the spacer means thereof.

For example, it can be seen in FIG. 1 that each adhesive layer means 22 and 26 of this invention has passage means 34 formed therein which lead to the exterior of the membrane keyboard construction 20 in a manner hereinafter set forth so that any air that becomes entrapped during the making of the membrane keyboard construction 20 will be vented from the areas of the adhesive layer means 22 and 26 that are adjacent to and aligned with the opening means 28 in the spacer means 24. In this manner, it can be seen that the normal distance between the surfaces 29 and 30 of the circuit layer means 23 and 25 of the membrane keyboard construction 20 of this invention is substantially the same as the thickness of the spacer means 24 at each opening means 28 thereof whereas in contrast the normal spacing provided between the surfaces 29A and 30A of the circuit layer means 23A and 25A at each opening 28A of the prior known membrane keyboard construction 20A of FIG. 2 is substantially less than the thickness of the spacer means 24A because of the entrapped air 33 thereof.

Figure 7:
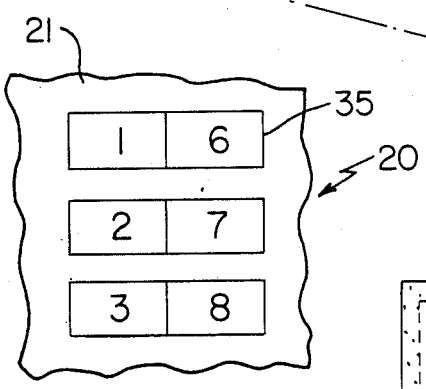
FIG. 7 is a fragmentary front view of the membrane keyboard construction of FIG. 6.

While the layers 21–26 of the membrane keyboard construction 20 of this invention can be formed of any suitable material, it can be seen in FIG. 4 that the face plate means 21 comprises a plastic sheet that can be suitably printed with a keyboard pattern in a manner well known in the art, such as with touch areas 35 as illustrated in FIG. 7 that are aligned with respective opening means 28 in the spacer means 24 which also comprises a plastic sheet and has the opposed sides 36 and 37 thereof secured to the facing sides 29 and 30 of the respective circuit layer means 23 and 25 by suitable adhesive means 38, such as a pressure sensitive adhesive means, disposed on the sides 36 and 37 of the spacer means 24. The circuit layer means 23 and 25 comprise sheets of any suitable electrically insulating material and having conductive printing disposed on the sides 29 and 30 thereof in a manner well known in the art, such conductive printing being in a predetermined pattern that is indicatd by the reference numeral 39 in FIGS. 5 and 6. The adhesive layer means 22 and 26 comprise sheets or film of any suitable plastic material having adhesive means 40, such as a pressure sensitive adhesive means, disposed on the opposed sides 41 and 42 thereof so as to secure the side 43 of the face plate means 21 to the side 44 of the circuit layer means 23 and the side 45 of the circuit layer means 25 to the side 46 of the backing plate means 27.

The adhesive layer means 22 and 26 each has been formed with a plurality of passage means 34 therein, such as by die cutting, that will lead from areas adjacent the opening means 28 in the spacer means 24 to the side edge means of the respective adhesive layer means 22 or 26, such side edge means being indicated by the reference numeral 47 in FIG. 5. In this manner the air that becomes entrapped during the rolling operation that laminates the layers 21–26 together will be vented from adjacent the opening means 28 to the exterior of the construction 20 for the purposes previously described.

While each adhesive layer means 22 or 26 can have the pattern of passage means 34 formed therein to specifically mate with the opening means 28 in the particular spacer means 24 being utilized therewith, it is believed according to the teachings of this invention that an adhesive sheet means can be formed with a certain pattern of passages therethrough which will permit that sheet means to be cut into adhesive layer means that can be used with various spacer means that have different patterns of opening means formed therein because the pattern of passage means will provide at least one passage means for being disposed adjacent an opening means.

Figure 8:
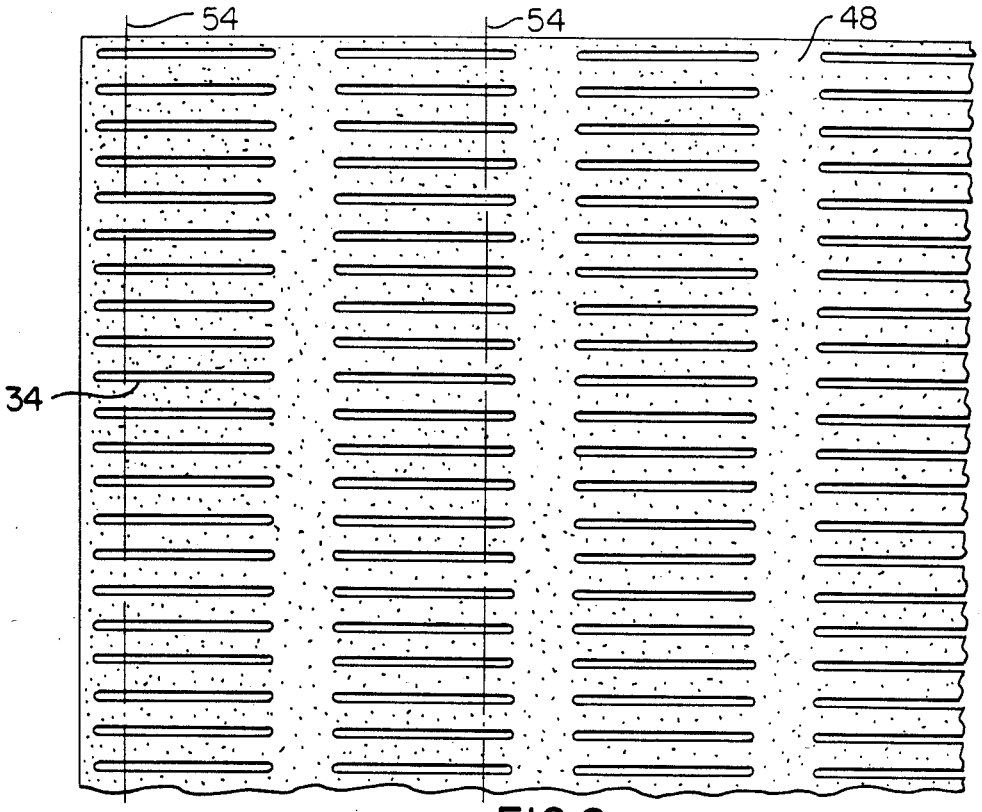
FIG. 8 is a fragmentary plan view of one adhesive sheet means of this invention.
Figure 9:
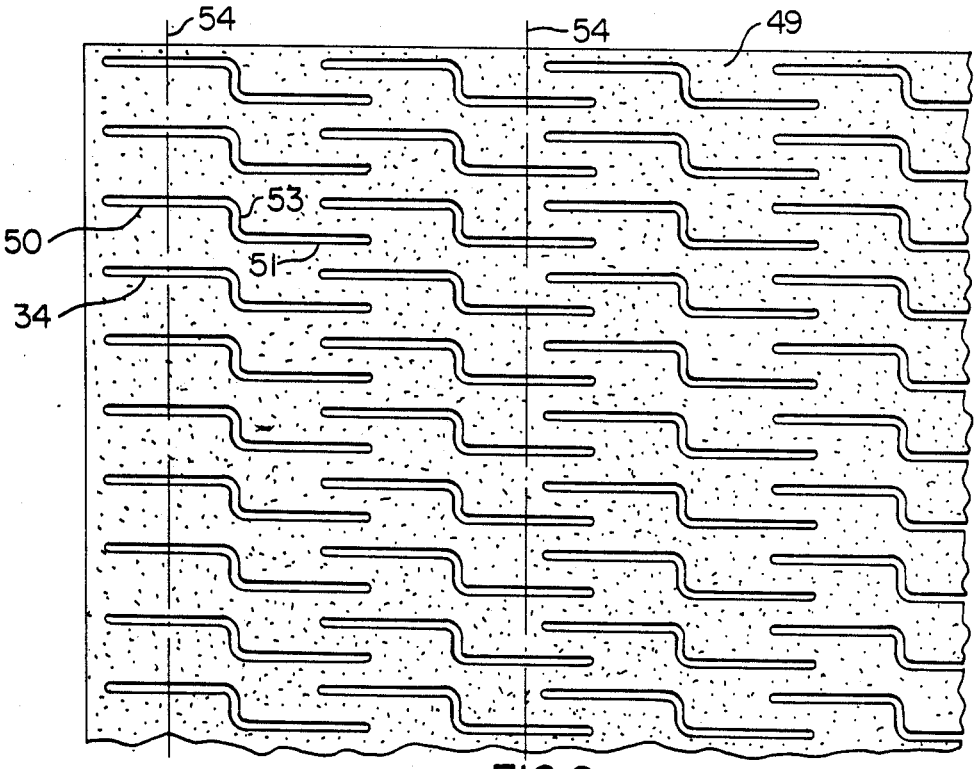
FIG. 9 is a fragmentary plan view of another adhesive sheet means of this invention.

For example, reference is now made to FIGS. 8 and 9 wherein adhesive sheet means 48 and 49 of this invention are respectively illustrated with a plurality of passages 34 formed therein in the repeating pattern illustrated, the passages 34 in the sheet means 48 having substantially the entire length thereof being substantially straight and disposed substantially parallel to the like parts of the other passage means 34 therein whereas the passage means 34 of the sheet means 49 each has two straight and parallel parts 50 and 51 thereof interconnected together by a part 53 disposed transverse thereto. However, it can be seen that when the sheet means 48 and 49 are cut to provide individual adhesive layer means 22 or 26, such as indicated by cut lines 54 in FIGS. 8 and 9, the passage means 34 each has an end that extends to a cut line 54 and this extends to the edge means 47 of resulting adhesive layer means 22 or 26 for the venting function thereof previously described.

Of course, it is to be understood that each passage 34 of the adhesive layer means 22 or 26 of this invention, or at least one such passage means 34, could interconnect with a vent opening formed in the respective face plate means 21 or backing plate means 27 or both so as to be interconnected to the exterior of the resulting membrane keyboard construction 20 without extending to the edge means 47 of that adhesive layer means 22 or 26.

For example, the particular adhesive layer means 26 illustrated in FIGS. 5 and 6 has a passage means 34A that leads to an opening means 55 that passes through all of the lyers 21–26 so as to provide a vent path to the exterior of the membrane keyboard construction 20 of FIGS. 5 and 6, the passage means 34A extending along a path that crosses a plurality of switch areas of the membrane keyboard construction 20 that are indicated by the reference numeral 56 in FIGS. 5 and 6.

As previously set forth, each switch area 56 is defined by an opening means 28 is the spacer means 24 with the circuit layer means 23 and 25 having the conductive printing on the facing sides thereof adapted to contact each other when an operator presses inwardly on a touch area 35 of the face plate means 21 that is aligned with that particular opening means 28 to close that switch means 56 for a control function for an appliance utilizing the particular membrane keyboard construction 20.

Therefore, it can be seen that each membrane keyboard construction 20 of this invention comprises two circuit layer means 23 and 25, spacer means 24 disposed and secured between the circuit layer means 23 and 25 and having at least one opening means 28 passing therethrough to permit the circuit layer means 23 and 25 to be pressed together in the opening means 28 and thereby provide a switching function, a face plate means 21, and an adhesive layer means 22 disposed between the face plate means 21 and one of the circuit layer means 23 and 25 and securing the face plate means 21 to the one circuit layer means 23, the adhesive layer means 22 having passage means 34 therein and leading from an area thereof that is aligned with the opening means 28 to the exterior of the construction 20 to vent that area thereof.

When the membrane keyboard construction 20 of this invention has another adhesive layer means 26 securing the other circuit layer means 25 to a backing plate means 27, the other adhesive layer 26 also has passage means 34 therein that leads from an area thereof that is aligned with the opening means 28 to the exterior of the construction 20 to vent that area thereof.

Accordingly, it can be seen that this invention provides a new membrane keyboard construction as well as a new method of making a membrane keyboard construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making a membrane keyboard construction comprising the steps of forming two circuit layer means, disposing and securing a spacer means between said circuit layer means, forming an opening means through said spacer means to permit said circuit layer means to be pressed together in said opening means and thereby provide a switching function, forming a face plate means, and disposing an adhesive layer means between said face plate means and one of said circuit layer means to secure said face plate means to said one circuit layer means, the improvement comprising the step of forming said adhesive layer means to have passage means therein so as to lead from an area thereof that is aligned in superimposed relation with said opening means to the exterior of said construction to vent said area thereof whereby said area is isolated from said opening means by said one circuit layer means and is vented by said passage means to tend to enhance tactile feel and avoid false switch closure of said opening means by tending to prevent entrapment of air bubbles in said area.

2. A method of making a membrane keyboard construction as set forth in claim 1 and including the steps of forming said adhesive layer means to have opposed spaced apart and substantially parallel sides and an outer peripheral end edge means extending between said opposed sides thereof, and forming said passage means to interrupt said peripheral end edge means.

3. A method of making a membrane keyboard construction as set forth in claim 1 and including the steps of forming said adhesive layer means to have opposed sides respectively facing said face plate means and said one circuit layer means, and forming said passage means to interrupt said opposed sides of said adhesive layer means and pass completely through said adhesive layer means throughout the length of said passage means.

4. A method of making a membrane keyboard construction as set forth in claim 1 and including the steps of forming said spacer means to have other opening means passing therethrough to permit said circuit layer means to be pressed together in each said other opening means to provide a switching function thereof, and forming said adhesive layer means to have other passage means respectively leading from areas thereof that are respectively aligned in superimposed relation with said other opening means to the exterior of said construction to vent said other areas thereof whereby each said other area is isolated from its respective opening means by said one circuit layer means and is vented by its respective passage means to tend to enhance tactile feel and avoid false switch closure of that respective opening means by tending to prevent entrapment of air bubbles in that said other area.

5. A method of making a membrane keyboard construction as set forth in claim 4 and including the step of forming said passage means to be arranged in a uniform pattern throughout the entire area of said adhesive layer means.

6. A method of making a membrane keyboard construction as set forth in claim 5 and including the steps of providing an adhesive sheet means having a plurality of said passage means arranged in said uniform pattern throughout the entire area of said adhesive sheet means, and cutting said adhesive layer means from said adhesive sheet means.

7. A method of making a membrane keyboard construction as set forth in claim 5 and including the step of forming each said passage means to be substantially straight and be substantially parallel to the other said passage means.

8. A method of making a membrane keyboard construction as set forth in claim 5 and including the step of forming each said passage means to have at least one part thereof that is substantially straight and is substantially parallel to said parts of the other said passage means.

9. A method of making a membrane keyboard construction as set forth in claim 1 and including the steps of disposing and securing another adhesive layer means against the other circuit layer means on the side thereof opposite said spacer means, forming passage means in said other adhesive layer means that leads from an area thereof that is aligned in superimposed relation with said opening means to the exterior of said construction to vent that said area thereof whereby said area of said other adhesive layer means is isolated from said opening means by said other circuit layer means and is vented by said passage means of said other adhesive layer means to tend to enhance tactile feel and avoid false switch closure of said opening means by tending to prevent entrapment of air bubbles in said area of said other adhesive layer means.

10. A method of making a membrane keyboard construction as set forth in claim 9 and including the steps of forming said spacer means with other opening means passing therethrough to permit said circuit layer means to be pressed together in each said other opening means to provide a switching function thereof, forming each said adhesive layer means to have other passage means respectively leading from areas thereof that are respectively aligned in superimposed relation with said other opening means to the exterior of said construction to vent said other areas thereof whereby each said other area is isolated from its respective opening means by its respective circuit layer means and is vented by its respective passage means to tend to enhance tactile feel and avoid false switch closure of that respective opening means by tending to prevent entrapment of air bubbles in that said other area.

11. A method of making a membrane keyboard construction as set forth in claim 9 and including the step of forming said passage means of each said adhesive layer means to be aligned with said passage means of the other said adhesive layer means.

12. In a method of making a membrane keyboard construction comprising the steps of forming two circuit layer means, disposing and securing a spacer means between said circuit layer means, forming an opening means through said spacer means to permit said circuit layer means to be pressed together in said opening means and thereby provide a switching function, forming a face plate means, forming a backing plate means, disposing a first adhesive layer means between said face plate means and one of said circuit layer means to secure said face plate means to said one circuit layer means, and disposing a second adhesive layer means between said backing plate means and the other of said circuit layer means to secure said other circuit layer means to said backing layer means, the improvement comprising the step of forming each said adhesive layer means to have passage means therein so as to lead from an area thereof that is aligned in superimposed relation with said opening means to the exterior of said construction to vent said area thereof whereby each said area is isolated from said opening means by its respective circuit layer means and is vented by its respective passage means to tend to enhance tactile feel and avoid false switch closure of said opening means by tending to prevent entrapment of air bubbles in that said area.

13. A method of making a membrane keyboard construction as set forth in claim 12 and including the steps of forming each said adhesive layer means to have opposed spaced apart and substantially parallel sides and an outer peripheral end edge means extending between said opposed sides thereof, and forming said passage means of each said adhesive layer means to interrupt said peripheral end edge means thereof.

14. A method of making a membrane keyboard construction as set forth in claim 12 and including the steps of forming each said adhesive layer means to have opposed sides respectively facing its respective plate means and circuit layer means, and forming said passage means of each said adhesive layer means to interrupt said opposed sides of its respective adhesive layer means and pass completely through its respective adhesive layer means throughout the length of said passage means.

15. A method of making a membrane keyboard construction as set forth in claim 12 and including the steps of forming said spacer means to have other opening means passing therethrough to permit said circuit layer means to be pressed together in each said other opening means to provide a switching function thereof, and forming each said adhesive layer means to have other passage means respectively leading from areas thereof that are respectively aligned in superimposed relation with said other opening means to the exterior of said construction to vent said other areas thereof whereby each said other area is isolated from its respective opening means by its respective circuit layer means and is vented by its respective passage means to tend to enhance tactile feel and avoid false switch closure of that respective opening means by tending to prevent entrapment of air bubbles in that said other area.

16. A method of making a membrane keyboard construction as set forth in claim 15 and including the step of forming said passage means of each said adhesive layer means to be arranged in a uniform pattern throughout the entire area of their respective adhesive layer means.

17. A method of making a membrane keyboard construction as set forth in claim 16 and including the step of forming each said passage means of each said adhesive layer means to be substantially straight and be substantially parallel to the other said passage means of its respective adhesive layer means.

18. A method of making a membrane keyboard construction as set forth in claim 16 and including the step of forming each said passage means of each said adhesive layer means to have at least one part thereof that is substantially straight and is substantially parallel to said parts of the other said passage means of its respective adhesive layer means.

19. A method of making a membrane keyboard construction as set forth in claim 16 and including the steps of providing an adhesive sheet means having a plurality of said passage means arranged in said uniform pattern throughout the entire area of said adhesive sheet means, and cutting said adhesive layer means from said adhesive sheet means.

20. A membrane keyboard construction as set forth in claim 12 and including the step of forming said passage means of each said adhesive layer means to be aligned with said passage means of the other said adhesive layer means.

* * * * *